US005102229A

United States Patent [19]

Wada et al.

[11] Patent Number: 5,102,229

[45] Date of Patent: Apr. 7, 1992

[54] AGITATOR

[75] Inventors: Makoto Wada; Ryuichi Yatomi; Haruyuki Nishimi, all of Toyo; Mamoru Mishima, Niihama; Masafumi Kuratsu, Toyo, all of Japan

[73] Assignee: Sumitomo Heavy Industries, Ltd, Tokyo, Japan

[21] Appl. No.: 679,854

[22] Filed: Apr. 3, 1991

[30] Foreign Application Priority Data

Jun. 15, 1990 [JP] Japan ..... 2-156935

[51] Int. Cl.[5] ..... B01F 7/16

[52] U.S. Cl. ..... 366/294; 366/295; 366/296; 366/309; 366/314

[58] Field of Search ..... 366/293, 294, 295, 296, 366/328, 329, 330, 327, 325, 64, 65, 66, 302, 307, 314, 309, 312

[56] References Cited

U.S. PATENT DOCUMENTS

| | | | |
|---|---|---|---|
| 877,468 | 1/1908 | Overkamp | 366/296 |
| 2,876,082 | 3/1959 | Morrison | 366/296 |
| 3,578,876 | 5/1971 | Stratienko | 366/293 |
| 4,403,868 | 9/1983 | Kupka | 366/295 |

*Primary Examiner*—Robert W. Jenkins
*Attorney, Agent, or Firm*—Armstrong, Nikaido, Marmelstein, Kubovcik and Murray

[57] ABSTRACT

Disclosed is an agitator including an agitation axis at the center of the agitator vessel, an agitator blade mounted on the agitation axis and consisting of a flat-plate-shaped blade disposed along the inner surface of the bottom wall of the agitator vessel and a grating-shaped blade continuous with the flat-plate-shaped blade, a baffle plate vertically extending for rotation around the agitator blade along the inner surface of the side wall of the agitator vessel, and drive equipment for rotating the baffle plate and the agitator blade independently from each other. When the agitator blade and the baffle plate are rotated at different speeds, circulating flow is formed in the vessel. The grating-shaped blade at the upper portion of the agitator blade shears a part of the circulating flow which descends along the radially inward agitation axis, thereby dividing that part of the flow into small parts. The small parts of the liquid are efficiently mixed together by the action of minute swirls generated behind the components of the grating-shaped blade.

7 Claims, 6 Drawing Sheets

AGITATOR

BACKGROUND OF THE INVENTION

1. Field of the Invention

The present invention relates to an agitator usable in batch processing of various viscous fluids performed in chemical, pharmaceutical and food industries to manufacture products in small quantities and in a variety of types. The agitator is also usable in processes in which, during the operation of the apparatus, reaction, dissolving or the like causes the liquid viscosity to change within a wide range, and the flow in the vessel to change from turbulent flow to laminar flow.

2. Description of the Related Art

The liquid flow characteristics within an agitator vessel greatly vary between a low-viscosity region (turbulent flow region) and a high-viscosity region (laminar flow region). Also, the manner of flowing and mixing varies between these regions.

In particular, in a low-viscosity region, the fluid and the blade rotate together. This phenomenon causes the formation of a solid-like rotary portion on the agitator axis, which may result in a mixing failure. For this reason, the provision of a baffle plate in the vessel is believed to be essential in general. The effect of the baffle plate, whose provision is essential for the low-viscosity region, diminishes, however, with increases in the liquid viscosity. In a high-viscosity region (laminar flow region), the provision of a baffle plate leads to the problem of a portion of the liquid remaining on and adhering to the back surface of the baffle plate. In the case of a low-concentration slurry liquid, a baffle plate is very effective to achieve uniform dispersion of solid particles. However, when the slurry concentration increases, the baffle plate acts to help solid particles to remain, deposit and solidify on the wall portion of the vessel interior.

Accordingly, when a process, etc. involving changes in viscosity within a wide range is to be performed, it has been the conventional practice to determine whether or not a baffle plate is to be provided in the agitator vessel for each of the low-viscosity, medium-viscosity and high-viscosity regions and to select a suitable shape of agitator blade accordingly.

Also, the conventional practice has coped with the above-described case by dividing the interior of the agitator vessel into a plurality of stages. When the shape of agitator blade is to be arranged for this purpose, a construction such as that shown in FIG. 6 has been adopted (Japanese Patent Unexamined Publication No. 57-45332). In this construction, an agitator vessel 1 has a helical ribbon blade 12 disposed therein, which is rotatable along the inner surface of the side wall of the vessel 1. Also, paddle blades 13 are radially provided on an agitation axis 2 at the center of the interior of the agitator vessel 1, which are rotatable in the opposite direction to that of the helical ribbon blade 12.

When the above-described case is to be coped with by using a baffle plate and arranging the shape of agitator blade, a construction such as that shown in FIG. 7 has been adopted (Japanese Patent Examined Publication No. 1-37173). In this construction, a flat-plate-shaped blade 6 is provided on a lower portion of an agitation axis 2 at the center of the interior of an agitator vessel 1, which is disposed along the inner surface of the bottom wall of the agitator vessel 1. A grating-shaped blade 7 continuing from the flat-plate-shaped blade 6 is provided on an upper portion of the agitation axis 2. Also, a plurality of baffle plates 14 are provided in a spaced relationship with each other on the inner surface of the side wall of the vessel 1, each baffle plate 14 extending axially from a lower position to an upper position of that inner surface.

With the agitator having the first construction where the helical ribbon blade 12 and the paddle blades 13 are used as the agitator blade, the agitator blade having a complicated structure makes operations such as charging, discharging and transferring difficult, thereby involving a risk of trouble Another disadvantage is that since no effective blade is provided in the bottom portion of the agitator vessel interior, the liquid flow in the bottom portion is extremely inactive. Further, an agitating operation cannot be started by charging a small amount of liquid. Still further, since the paddle blades 13 disposed radially inward of the helical ribbon blade 12 are provided in a plurality of stages, the circulating flow generated by each paddle blade 13 in one of the stages collides with another circulating flow at the intermediate surface between these stages, thereby forming a remaining portion. Such a remaining portion acts as a boundary which deteriorates the degree of inter-stage mixing. Further, when the liquid level changes, this causes a change in the relationship between the position of the liquid surface and the position at which the blades are mounted. Thus, a change in the liquid level leads to a difference in the mixing condition. Furthermore, a flow discharged by a paddle blade 13 in the radial direction of the vessel hinders a downward flow caused by the radially outward helical ribbon blade 12. As a result, the overall circulating flow inevitably becomes insufficient.

The agitator having the second construction where the agitator blade consisting of the flat-plate-shaped blade 6 and the grating-shaped blade 7 continuous therewith is used together with the baffle plates 14, does not entail the disadvantages of the first agitator, and the apparatus is advantageous in that the flow generating characteristics of the agitator blade enable a reduction in the mixing period, and that the applicable viscosity range is wide. However, the provision of the baffle plates 14 inevitably leads to problems such as those described above, that is, formation of a remaining portion on the back surface of the baffle plates when the liquid viscosity increases, occurrence of flow failure in a high viscosity region, and remaining, deposition and solidification of solid particles on the wall portion of the vessel interior when the slurry concentration increases.

SUMMARY OF THE INVENTION

The present invention has been accomplished to overcome the problems of an agitator of the second type, and aims to make an agitator operable with effective liquid mixing characteristics even at high viscosities and high concentrations to thereby achieve a drastic expansion of the range within which a single apparatus is applicable, while preventing remaining, deposition and solidification of solid particles on the side wall portion of the vessel interior at high concentrations.

To this end, according to the present invention, there is provided an agitator comprising: an agitator vessel; first and second agitation axes rotatably provided at the center of the agitator vessel; an agitator blade mounted on the first agitation axis, the agitator blade consisting of a flat-plate-shaped blade disposed along the inner surface of the bottom wall of the agitator vessel and a grating-shaped blade disposed above the flat-plate-shaped blade continuously therewith; at least one baffle plate mounted on the second agitation axis, the baffle plates extending outside the range within which the agitator blade rotates, and vertically along the inner surface of the side wall of the agitator vessel; and drive equipment for rotating the first and second agitation axes independently from each other.

DESCRIPTION OF THE PREFERRED EMBODIMENTS

Figure 1:
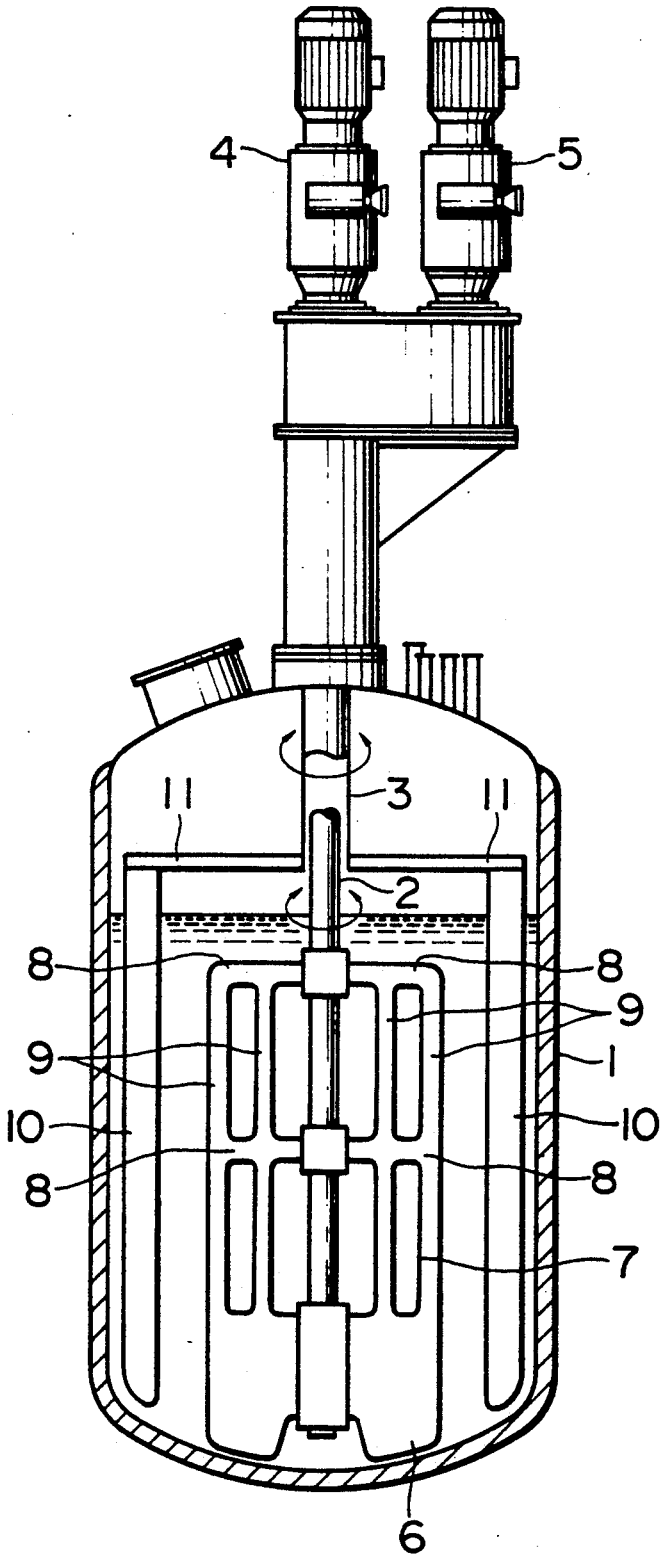
FIG. 1 is a front sectional view of an embodiment of the present invention.

Referring to FIG. 1, an agitator according to an embodiment of the present invention has a cylindrical agitator vessel 1. Disposed at the center of the interior of the agitator vessel 1 are an inner agitation axis 2 extending to a position in the vicinity of the bottom wall of the vessel 1 and an outer agitation axis 3 extending to a position above the liquid surface level, the inner and outer axes 2 and 3 being fitted together while rotatable relative to each other. These agitation axes 2 and 3 can be stopped and rotated independently from each other by drive devices 4 and 5, respectively, provided above the upper wall of the agitator vessel 1. The direction and the speed of the respective rotations of the agitation axes 2 and 3 can be controlled independently from each other.

The agitator includes a flat-plate-shaped blade 6 disposed along the inner surface of the bottom wall of the agitator vessel 1. The blade 6 is mounted on a lower portion of the inner agitation axis 2, and is in sliding contact with the inner surface of the bottom wall of the vessel 1.

The flat-plate-shaped blade 6 has both the characteristics (the discharging characteristics) of a conventionally known paddle blade and the characteristics (the shearing and scraping characteristics) of a conventionally known horse-shoe-type or anchor-type blade. Specifically, the blade 6 has the characteristics of a paddle blade whereby liquid is discharged in the radial direction of the vessel, and the characteristics of a horse-shoe-type or anchor-type blade whereby the substances adhering to the wall surface are scraped off, scattered and floated.

A grating-shaped blade 7 continues from the flat-plate-shaped blade 6, and is mounted, as the blade 6, on the inner agitation axis 2. The grating-shaped blade 7 consists of a plurality of flat-bar-shaped horizontal ribs 8 extending radially of the vessel 1 and a plurality of flat-bar-shaped vertical strips 9 extending vertically, that is, perpendicularly to the horizontal ribs 8. The grating-shaped blade 7 has certain characteristics with which, during the rotation of the blade 7, the respective end portions of the components of the blade 7 shear the liquid and divide it into small parts, and the small parts of the liquid divided are mixed together by the action of minute swirls generated behind those components.

The flat-plate-shaped blade 6 and the grating-shaped blade 7 are integrally formed to constitute an agitator blade. In the following descriptions, the blades 6 and 7 will therefore be referred to generically as "the agitator blade" unless otherwise specified.

Although each of the above-described vertical strips 9 extends across all of the horizontal ribs 8, this is a mere example. Alternatively, the vertical strips 9 may be combined with different ones of the horizontal ribs 8. The horizontal ribs 8 are provided to reinforce the grating-shaped blade 7. Needless to say, the number of the horizontal ribs 8, which is determined by the dimensions of the blade 7, is not limited to that of the illustrated embodiment, and may be other than two.

The apparatus further includes a plurality of baffle plates 10 detachably mounted on the distal ends of linkage ribs 11 provided on the outer agitation axis 3. The baffle plates 10 vertically extend outside the range of rotation of the agitator blade 6, 7, and are in sliding contact with the inner surface of the side wall of the agitator vessel 1. Examples of baffle plates are shown in FIGS. 2A to 2C.

Figure 2A:
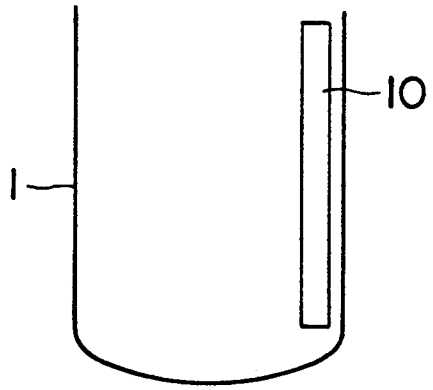
FIGS. 2A, 2B and 2C are views schematically showing three different examples of baffle plates for the apparatus according to the present invention.
Figure 3A:
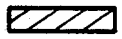
FIGS. 3A, 3B, 3C and 3D are views showing four different examples of the sectional configuration of the baffle plates.
Figure 3B:
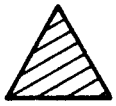
Figure 3C:
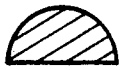
Figure 3D:
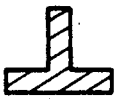

FIG. 2A illustrates a baffle plate 10 extending vertically straight along the side wall of the agitator vessel 1. The baffle plate 10 may have various sectional configurations. In general, the baffle plate 10 is a flat plate having a rectangular section, as shown in FIG. 3A. The baffle plate 10 may, however, have a triangular section, as shown in FIG. 3B, a semi-circular section, as shown in FIG. 3C, or a T-shaped section, as shown in FIG. 3D.

Figure 2B:
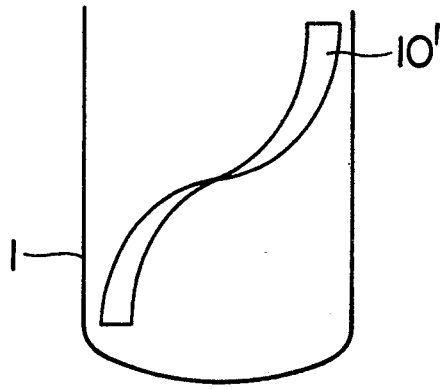
Figure 2C:
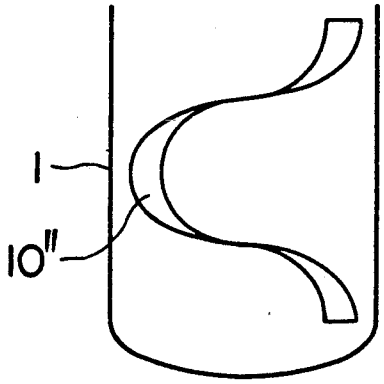

FIGS. 2B and 2C illustrates baffle plates having certain counter angles. FIG. 2B illustrates a baffle plate 10' having a counter angle determined by a pitch (0.5) relative to the vertical length of the agitator blade. FIG. 2C illustrates a baffle plate 10'' having a counter angle determined by a different pitch (1.0) relative to the vertical length of the agitator blade.

If the counter angle is too great, the baffle plate is not very effective. Therefore, the pitch determining the counter angle should preferably be a value which is not greater than 1.5 relative to said length.

The baffle plates 10, 10' or 10'' have the characteristics of: causing the flow radially discharged by the rotation of the flat-plate-shaped blade 6 to ascend along the inner surface of the side wall of the vessel, so as to form circulating flow in the vessel; causing the substances adhering to the wall surface to be scraped off, scattered and floated; and pushing the liquid when the viscosity increases so as to keep it in motion and reduce the risk of a drop in the flow speed at the side wall portion of the vessel interior.

Although a plurality of baffle plates 10, 10' or 10'' are used in the apparatus, the number of baffle plates may be suitably increased or decreased (even to one) in accordance with the condition of use.

Figure 5:
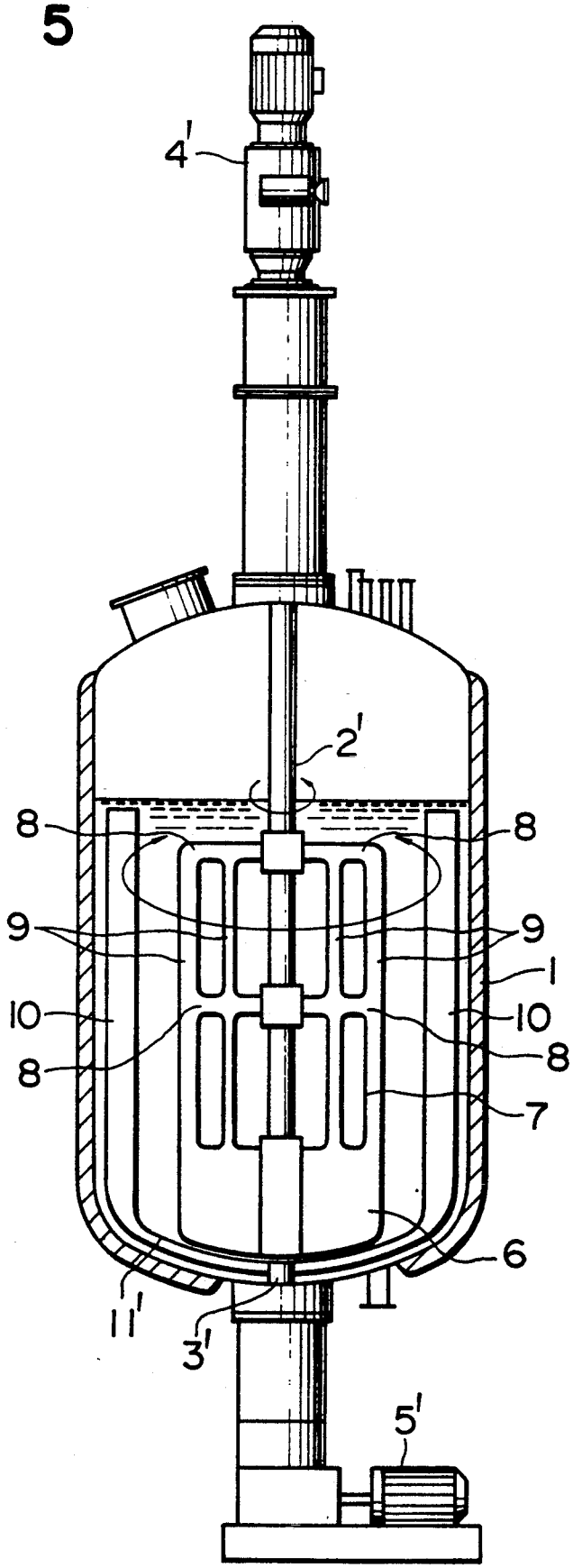
FIG. 5 is a front sectional view of another embodiment of the present invention.
Figure 6:
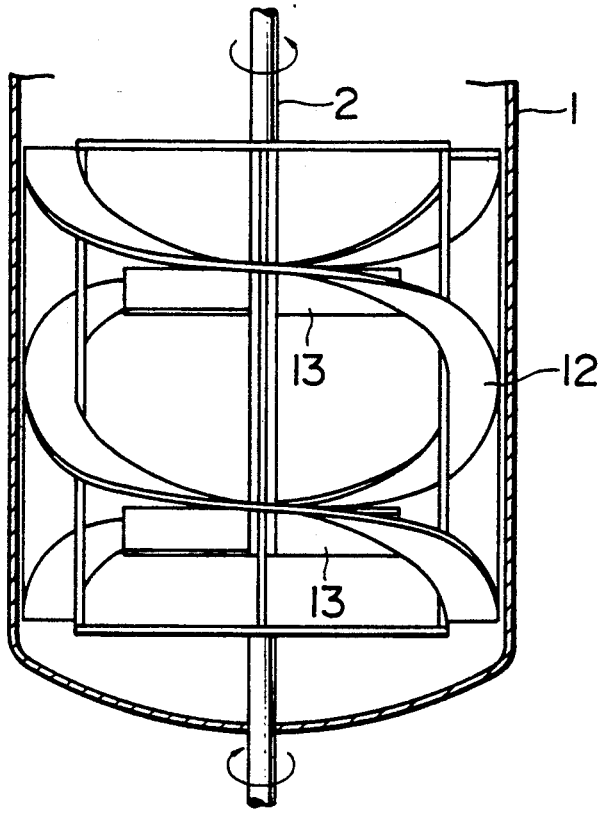
FIG. 6 PRIOR ART
FIG. 6 is a front sectional view of a conventional agitator.
Figure 7:
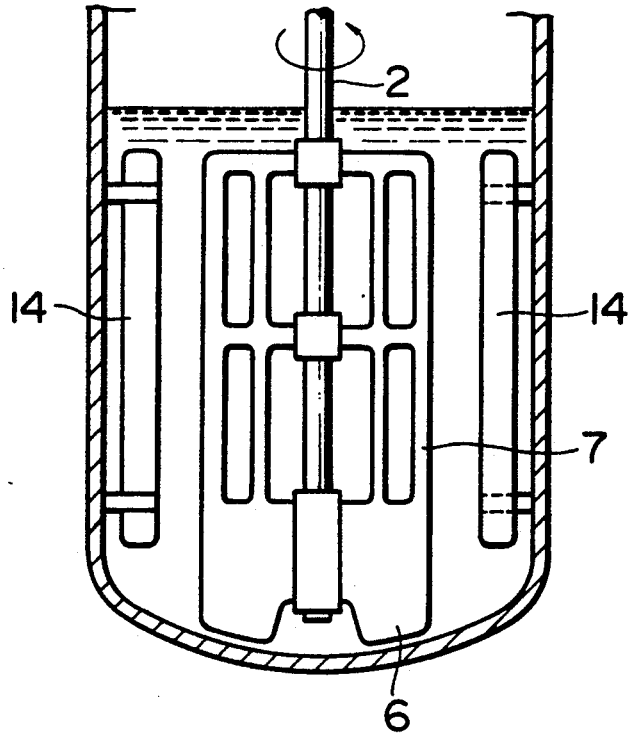
FIG. 7 PRIOR ART
FIG. 7 is a front sectional view of another conventional agitator.

FIG. 5 shows another embodiment of the present invention. The embodiment shown in FIG. 5 is distinguished from the first embodiment shown in FIG. 1 in which the agitator axis has a double axis structure consisting of the inner agitation axis 2 and the outer agitation axis 3. Specifically, the second embodiment is distinguished by the arrangements in which an agitation axis 2' for the agitator blade which corresponds to the inner agitation axis 2 is driven by a drive device 4' provided above the upper wall of the agitator vessel 1, and an agitation axis 3' for the baffle plates which corresponds to the outer agitation axis 3 is driven by a driving device 5' provided at the bottom portion of the agitator vessel 1. The other arrangements of the second embodiment are the same as those shown in FIG. 1, and detailed descriptions of these arrangements will be omitted.

Figure 8:
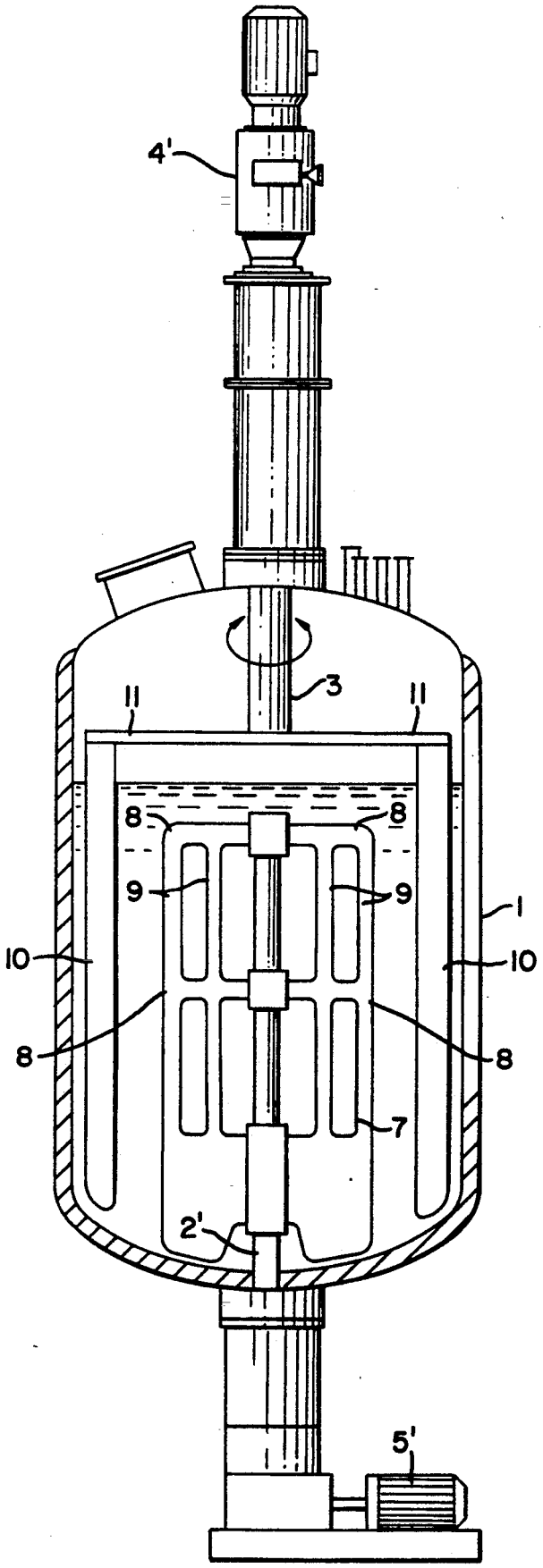
FIG. 8 is a sectional view of an additional embodiment of the invention.

Although not shown, the embodiment shown in FIG. 1 may be modified so that the agitation axes 2 and 3, forming a double axis structure, are driven from below by the drive devices 4 and 5 provided on the bottom portion of the agitator vessel 1. Further, as shown in FIG. 8, the embodiment shown in FIG. 5 may be modified so that the drive device 4' for the agitator blade agitation axis 3' is provided at the upper portion of the vessel 1, while the drive device 5' for the ais 2' is provided above the lower wall of the vessel 1.

With the above-described construction, the agitation axis 2 or 2' on which the agitator blade 6, 7 is mounted, and the agitation axis 3 or 3' on which the baffle plates 10, 10' or 10'' are mounted are driven by an external drive system, i.e., the drive device 4 or 4' and the drive device 5 or 5', respectively, at different speeds of rotation. Also, the direction of the rotation of these axes are suitably set in accordance with the liquid to be processed and the purpose of the operation.

The ratio between the respective rotational speeds of the agitation axis 2 or 2' and the agitation axis 3 or 3' is changed by appropriately setting the ratio in accordance with various characteristics of the liquid. When the agitator blade 6, 7 is rotated by the rotation of the agitation axis 2 or 2' and the baffle plates 10, 10' and 10'' are rotated by the rotation of the agitation axis 3 or 3', the flow described below is formed in the agitator vessel 1.

Figure 4:
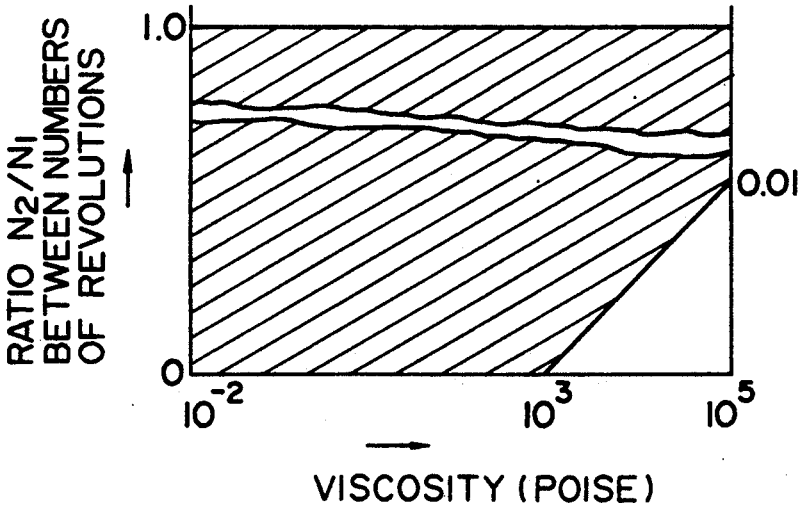
FIG. 4 is a graph showing the example of a relationship between the liquid viscosity and the ratio representing the rotational speeds of the agitator blade and the baffle plates according to the present invention.

FIG. 4 is a graph in which the abscissa represents the viscosity (poise) of the liquid agitated, while the ordinate represents the ratio (N2/N1) between the absolute value N1 of the number of revolutions per unit time of the agitator blade and the absolute value N2 of that of the baffle plates. Thus, the graph shows the example of a relationship between the viscosity and the rotational speeds of the agitator blade and the baffle plates.

Although the ratio between the numbers of revolutions of the agitator blade 6, 7 and the baffle plates 10, 10' or 10'' is varied in accordance with the properties of the material (liquid) being agitated, the ratio is generally changed in accordance with the viscosity in such a manner that, in a low-viscosity region, the agitator blade and the baffle plates are rotated at a great ratio. With such rotation, a great circulating flow is formed in the agitator vessel 1. Specifically, the liquid is radially discharged by the flat-plate-shaped blade 6 at the lower portion of the agitator blade while the liquid is being prevented from adhering to the inner surface of the lower wall portion of the vessel 1. The flow of the discharged liquid is interfered by the baffle plates 10, 10' or 10'' in such a manner as to be restrained from circular motion and to ascend along the inner surface of the side wall of the vessel toward the upper portion of the vessel interior. Then, the flow moves in the upper portion from a position close to the side wall to a central position, descends along the agitation axis 2 or 2', and returns to the position of the flat-plate-shaped blade 6.

The horizontal ribs 8 and the vertical strips 9 of the grating-shaped blade 7 at the upper portion of the agitator blade acts to normally shear a part of the circulating flow which descends along the agitation axis 2 or 2'. As a result, the liquid is divided into small parts with small power consumption. The small parts of the liquid are mixed together by the action of minute swirls generated behind the horizontal ribs 8 and the vertical strips 9. Thus, the mixing operation is completed within a short period.

On the other hand, in a high-viscosity region, the agitator blade 6, 7 and the baffle plates 10, 10' or 10'' are rotated at a relatively small ratio between the numbers of revolutions. With such rotation, the baffle plates 10, 10' or 10'' cause the substances adhering to the wall surface to be scraped off, scattered and floated, and also act to reduce the risk of a drop in the liquid flow speed at the side wall portion of the vessel interior when the viscosity increases.

In addition, the rotating baffle plates 10, 10' or 10'' are free from any remaining or motionless portion formed on the back surface thereof. Therefore, it is possible to assure that the above-described formation of circulating flow, the dividing of the liquid into small parts and the mixing of the parts, which are all necessary to uniform mixing, are sufficiently performed, while the scraping off of the substances from the wall surface greatly reduces the risk of substances remaining on and adhering to the side wall of the vessel. Furthermore, in the case of a liquid such as a high concentration slurry, the rotating baffle plates 10, 10' or 10'' enable the substances deposited on the wall surface to be scraped off before they coagulate and solidify, thus enabling them to be replaced.

The present invention having the above-described construction provides the following effects:

(1) The agitator blade and the baffle plates which are rotated with a difference in rotational speed enables circulating flow to be formed in the agitation vessel. The grating-shaped blade at the upper portion of the agitator blade shears that part of the circulating flow descending along the inner agitation axis, thereby dividing the liquid into small parts. The small parts of the liquid are efficiently mixed together by the action of minute swirls generated behind the components of the grating-shaped blade.

Even during high-viscosity, high-concentration operations, which are particularly difficult to perform successfully, the baffle plates act to prevent any portion of the substances being processed from remaining, depositing, solidifying, and adhering (and additionally fusing when the slurry is heated) on the side wall portion of the vessel interior, and to cause any such deposit to be scattered and floated. This action is performed without any of the substances remaining on and adhering to the back surface of the baffle plates. Thus, even in such an operation, the dissolving of the undissolved substances is promoted, and the risk of a drop in the liquid flow speed at the side wall portion of the vessel interior is reduced, thereby assuring the above-described liquid mixing characteristics. This in turn makes it possible to maintain or improve uniform mixing performance and good heat-transfer and heat-dissipation performance. Furthermore, it is possible to achieve mixing characteristics which are stable throughout from a low viscosity region (turbulent flow region) to a high viscosity region (laminar flow region). This feature makes the agitator effectively usable as a reaction vessel.

(2) The above-described excellent liquid mixing characteristics enable an agitating operation for, e.g., crystallization, emulsion polymerization, or highly cohesive slurry to be performed with a very low rotational speed of the blade and at a very low level of power consumption.

(3) With the baffle plates having an angle of attack with respect to the direction of flow, it is possible, when the viscosity is high, to increase the ascending part of circulating flow along the inner surface of the side wall of the vessel.

(4) If the speed and the direction of rotation of the baffle plates is adjusted in relation to the speed and the direction of rotation of the agitator blade, it is possible to control the shearing force applied to the liquid within the agitator vessel.

What is claimed is:

1. An agitator comprising: an agitator vessel; first and second agitation axes rotatably provided at the center of said agitator vessel; an agitator blade mounted on said first agitation axis; said agitator blade consisting of a flat-plate-shaped blade disposed at a lower portion of said agitator vessel and a grating-shaped blade disposed above said flat-plate-shaped blade continuously therewith; at least one baffle plate mounted on said second agitation axis, said at least one baffle plate extending outside the range within which said agitator blade rotates, and vertically along the inner surface of the side wall of said agitator vessel; and drive equipment for rotating said first and second agitation axes independently from each other.

2. An agitator according to claim 1, wherein said first agitation axis is projected from an upper portion of said agitator vessel, while said second agitation axis is projected from a lower portion of said agitator vessel.

3. An agitator according to claim 1, wherein said first and second agitation axes together form a double-axis structure, said first agitation axis being the inner axis of the structure and said second agitation axis being the outer axis of the structure.

4. An agitator according to any of claims 1 to 3, wherein said baffle plate is composed of a straight plate extending along the side wall of said agitator vessel.

5. An agitator according to any of claims 1 to 3, wherein said baffle plate has a counter angle determined by a pitch relative to the length of said agitator blade, said pitch being not greater than 1.5.

6. An agitator according to claim 1, wherein at least one of said agitator blade and said at least one baffle plate are in sliding contact with the inner wall surfaces of said agitator vessel for scraping off substances therefrom.

7. An agitator according to claim 1, wherein said first agitation axis is projected from a lower portion of said agitator vessel, while said second agitation axis is projected from an upper portion of said agitator vessel.

* * * * *